US006805592B2

(12) United States Patent
Kurimoto

(10) Patent No.: US 6,805,592 B2
(45) Date of Patent: Oct. 19, 2004

(54) CONNECTOR

(75) Inventor: Naoya Kurimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/722,345

(22) Filed: Nov. 26, 2003

(65) Prior Publication Data

US 2004/0106332 A1 Jun. 3, 2004

Related U.S. Application Data

(63) Continuation of application No. 09/455,804, filed on Dec. 7, 1999, now Pat. No. 6,655,998.

(30) Foreign Application Priority Data

Dec. 9, 1998 (JP) ..... 10-350349

(51) Int. Cl.[7] ..... H01R 13/514
(52) U.S. Cl. ..... 439/752; 439/595
(58) Field of Search ..... 439/595, 752, 439/271–275, 744

(56) References Cited

U.S. PATENT DOCUMENTS 5,116,236 A * 5/1992 Colleran et al. ..... 439/271
5,281,168 A * 1/1994 Krehbiel et al. ..... 439/595
5,503,573 A * 4/1996 Sagawa ..... 439/752
5,607,327 A * 3/1997 Tsuji et al. ..... 439/752
5,647,778 A * 7/1997 Yamaguchi et al. ..... 439/752
5,769,664 A * 6/1998 Saito et al. ..... 439/595
5,782,657 A * 7/1998 Wolla et al. ..... 439/595
5,860,835 A * 1/1999 Ohsumi ..... 439/595
5,947,775 A * 9/1999 Yamamoto et al. ..... 439/752

FOREIGN PATENT DOCUMENTS

| | | |
|---|---|---|
| DE | 44 39 386 | 5/1996 |
| DE | 195 06 234 | 8/1996 |
| EP | 0 867 976 | 9/1999 |

* cited by examiner

*Primary Examiner*—Hien Vu
(74) *Attorney, Agent, or Firm*—Banner & Witcoff, Ltd.

(57) ABSTRACT

A connector is capable of being miniaturised, whilst inadvertent pushing in of a retainer is prevented.

A housing main body 2 into which female terminal fittings are inserted has a retainer insertion groove 23 formed on a side face thereof, a retainer 14 being inserted into this retainer insertion groove 23. The retainer 14 is maintained in a temporary stopping position which allows the insertion of the female terminal fittings into cavities thereof. After that, the retainer 14 is pushed further in and maintained in a main stopping position where is engages stepped members of the female terminal fittings. When the retainer 14 is in the temporary stopping position, the posterior end (relative to the direction of insertion) of this retainer 14 is inside the housing main body 2. As a result, the retainer 14 is not pushed inadvertently into the main stopping position while, for example, the connector is being transported to a site where the female terminal fittings are to be inserted. A hood member 35 does not need to perform the function of protecting the retainer 14, consequently its size can remain small so as merely to cover a sealing ring 10.

8 Claims, 10 Drawing Sheets

CONNECTOR

RELATED APPLICATION

This application is a continuation of Ser. No. 09/455,804 filed Dec. 7, 1999, now U.S. Pat. No. 6,655,998, the disclosure of which is hereby incorporated by reference.

TECHNICAL FIELD

The present invention relates to an electrical connector provided with a side retainer.

BACKGROUND TO THE INVENTION

One type of connector is provided with a side retainer. In this type of connector, a retainer insertion opening is formed on a side face of a housing provided with a plurality of cavities, and a retainer is inserted into this retainer insertion opening. This retainer is provided with a stopping protrusion capable of being engaged against stepped members or the like formed on the terminal fittings. Once the retainer has been inserted, first the stopping protrusions move away to sides of the cavities and the retainer is maintained in a temporary stopping position and, in that state, the terminal fittings can be inserted into the cavities and are engaged by lances. Next the retainer is pushed in further to a main stopping position, the stopping protrusions protrude into the cavities and are engaged against the stepped members of the terminal fittings, thereby doubly stopping the terminal fittings in an unremovable state. In this side retainer, the terminal fittings can be engaged directly, and thus has the advantage of having a strong retaining force.

It is normal with this type of side retainer for a posterior edge (relative to the direction of insertion of the retainer) of the retainer to protrude from a side face of the housing when the retainer is in the temporary stopping position. This can be felt when one touches the housing with one's hands, and it can thus easily be detected if one forgets to insert the retainer to the main stopping position and leaves it in the temporary stopping position.

However, in the above configuration, since the retainer protrudes when in the temporary stopping position, there is the danger that the retainer may be accidentally inserted to the main stopping position during transit, etc. before the terminal fittings have been inserted. Consequently, the inadvertent insertion of this type of retainer can be prevented by covering the inserting location of the retainer with a protecting member. However, if this is done there is the problem that the housing must be large. The present invention has been developed after taking the above problem into consideration, and aims to present a connector capable of being miniaturised and in which the retainer will not be inserted inadvertently.

SUMMARY OF THE INVENTION

According to the invention there is provided an electrical connector comprising a housing having a plurality of parallel terminal insertion cavities therein, each of said cavities being adapted to receive one of a plurality of electrical terminals, the housing further including an end adapted to receive a mating connector, a retainer cavity intersecting said insertion cavities, and a retainer movable in said retainer cavity between a first position in which in use said terminals can move in a respective insertion cavity, and a second position in which in use said terminals are latched against movement in a respective insertion cavity, wherein said retainer is wholly within said housing. Such a retainer is not susceptible to accidental contact with an external object, and accordingly there is no need for an external shield which would increase the overall size of the housing.

Preferably the housing has an external opening or window to permit the position of the retainer to be verified. In a preferred embodiment the retainer can be both viewed and moved from the end of the housing adapted to receive a mating connector. The retainer may have a discontinuity. such as a protrusion, to permit movement thereof and to prevent full engagement of a mating connector unless the retainer is in the correct position. The discontinuity may for example be part of a concave/convex form fitting construction.

BRIEF DESCRIPTION OF DRAWINGS

One feature of the invention will be apparent from the following description of a preferred embodiment shown by example only in the accompanying drawings in which.

DESCRIPTION OF PREFERRED EMBODIMENT

Figure 1:
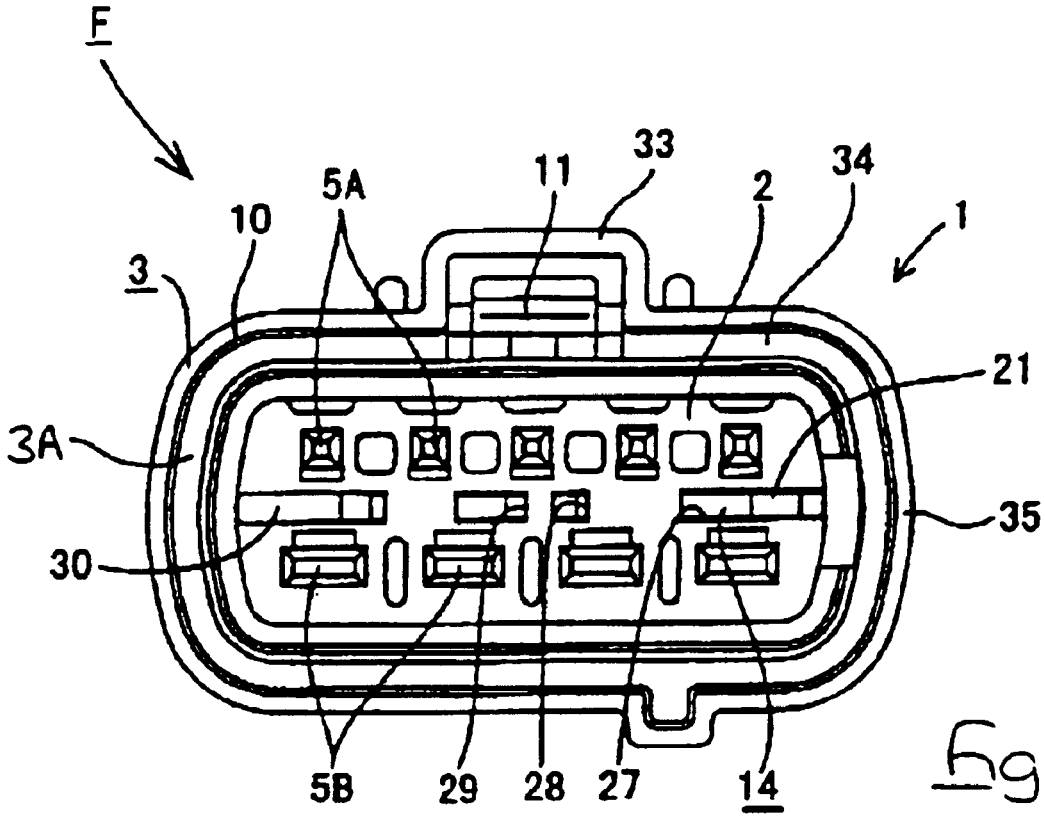
FIG. 1 is a front view of a female connector of an embodiment of the present invention.

An embodiment of the present invention is described below with the aid of FIGS. 1 to 18.

The present embodiment is provided with a pair of hybrid male and female waterproof connectors capable of fitting mutually together. First the female connector F will be explained with the aid of FIGS. 1 to 11.

The female connector F has a female housing 1 formed from plastic and, as shown in FIGS. 1 to 4, this comprises a housing main body 2 which has a cross-sectionally oblong shape and a hood 3 which is formed separately and attached thereto to define an annular chamber 3A.

Five small cavities 5A are formed in an aligned manner at an upper level within the housing main body 2, and four large cavities 5B are formed in an aligned manner at a lower level within the housing main body 2. Small female terminal fittings 6A are inserted into the small cavities 5A, and large female terminal fittings 6B are inserted into the large cavities 5B, these terminal fittings 6A and 6B being inserted from the posterior and being mutually over one another (see FIG. 11). A metal lance 7 provided on each of these terminal fittings 6A and 6B fits into a stopping groove 8 provided on a side wall of each cavity 5A and 5B, thereby retaining and housing the terminal fittings 6A and 6B in an unremovable state. A stopping rib 34 is provided along an entire outer circumference face of the housing main body 2 at a location slightly to the anterior of the centre thereof in a length-wise direction. A sealing ring 10 of a specified width is mounted at a posterior face of this stopping rib 34.

Figure 3:
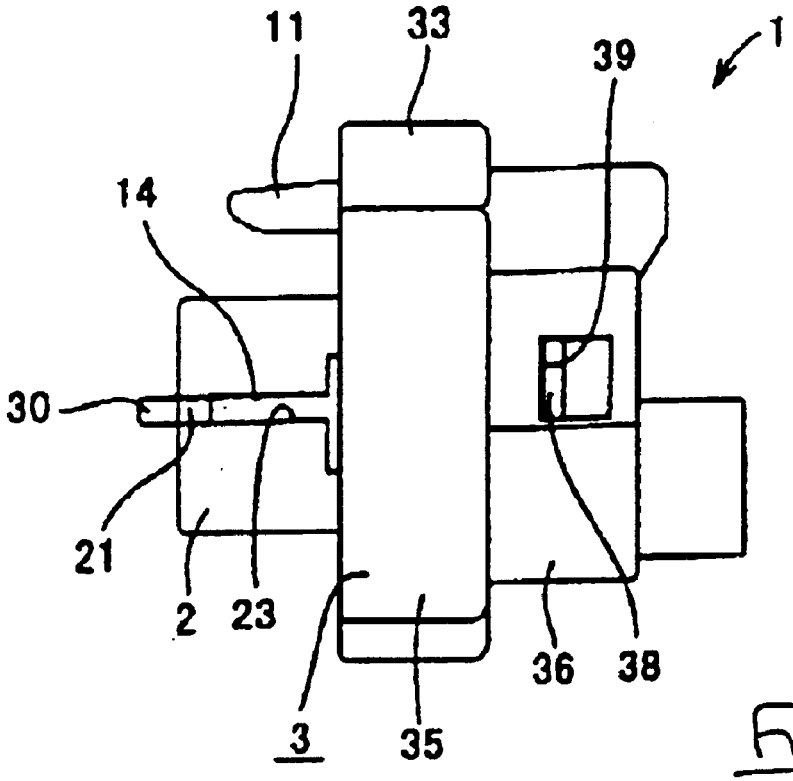
FIG. 3 is a side view corresponding to FIG. 1.
Figure 4:
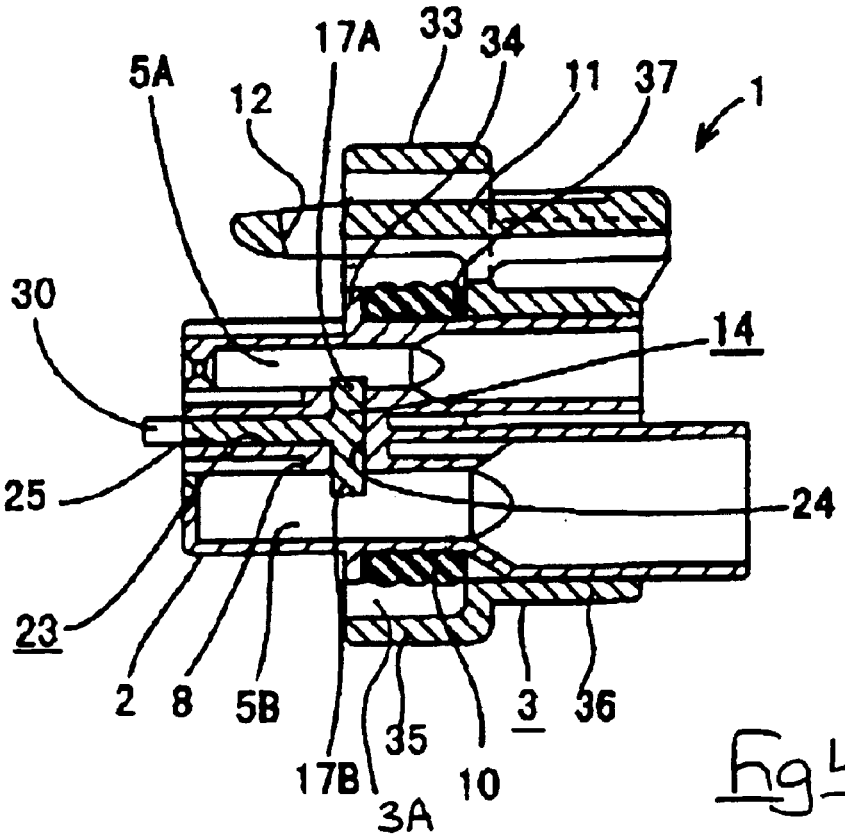
FIG. 4 is a vertical cross-section through the embodiment.

As shown in FIG. 4, the hood has a stepped shape and comprises: a short hood member 35 which covers outer sides of the locations where the sealing ring 10 is attached; and, at a posterior face side of this hood member 35, an attachment cylinder 36 which is reduced in diameter and which is fitted onto an outer circumference face of a posterior end of the housing main body 2. When the hood 3 is inserted from the posterior onto the outer side of the housing main body 2, stepped members 37 at the innermost sides of the hood member 35 make contact with posterior end of the sealing ring 10 which has already been installed and, as shown in FIG. 3, protrusions 38 which protrude from side faces of the housing main body 2 fit with attachment holes 39 of the attachment cylinder 36, and the hood is thereby attached in a unified manner.

After the hood member 3 has been attached, the short hood member 35 covers the area from the sealing ring 10 to the stopping rib 34, and the sealing ring 10 is clamped and maintained between the stopping rib 34 and the stepped members 37.

An arch member 33 rising up from the step is formed, at a central location in a width-wise direction, on an upper face of the hood member 35. A locking arm 11 is formed on an interior side thereof and extends in an anterior-posterior direction.

When the female connector F is fitted with a corresponding male connector M (to be described), a cylinder fitting member 42 (see FIG. 13) of a male housing 41 is inserted into the hood member 35 from an end 1A, whereupon the sealing rings 10 are gripped resiliently between the cylindrical fitting member 42 and the housing main body 2, creating a seal between the female connector F and the male connector M. Moreover, a protrusion 43 on the male housing 41 fits into a stopping hole 12 of the locking arm 11, thereby locking the two connectors F and M in a fitted state.

Figure 5:
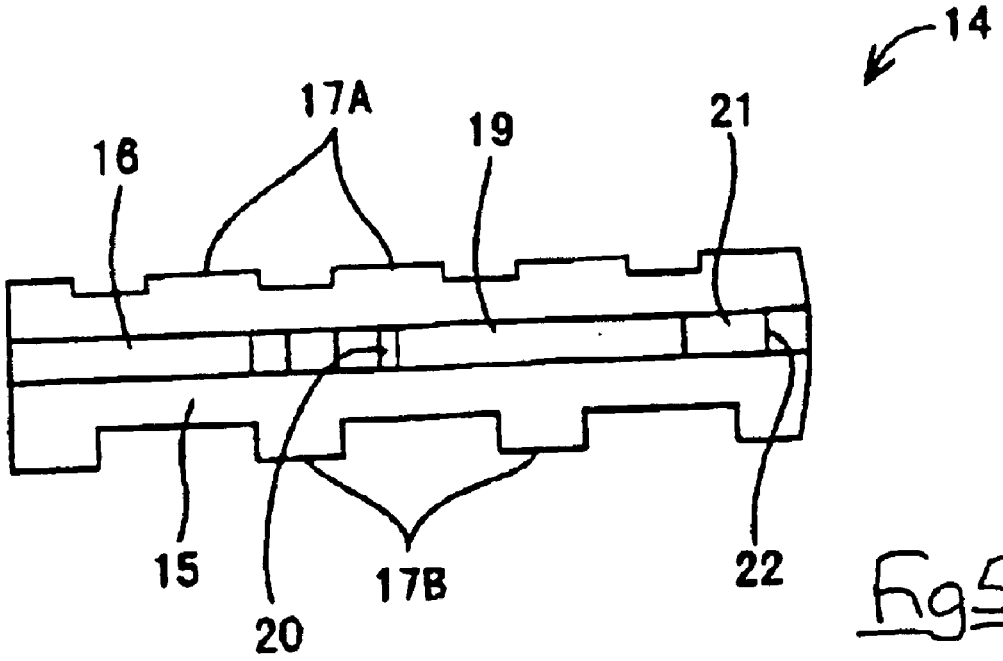
FIG. 5 is a plan view of a retainer.
Figure 6:
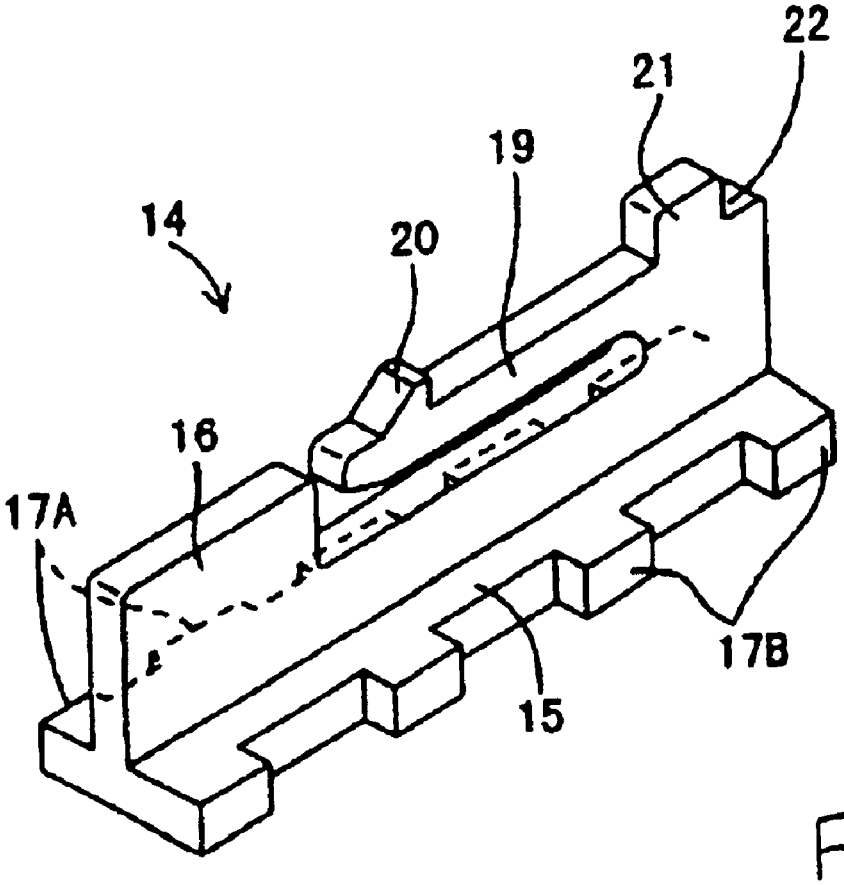
FIG. 6 is a diagonal view of the retainer.

A retainer 14 can be installed on the housing main body 2 in order to doubly stop the female terminal fittings 6A and 6B. This retainer 14 is made from plastic and is formed as shown in FIGS. 5 and 6. Specifically, the retainer 14 has a length slightly shorter than the width of the housing main body 2 and a guiding plate 16 protrudes at a right angle from a central position, in a width-wise direction, of a base plate 15, thus forming a cross-sectional T-shape. Five stopping protrusions 17A are formed on one edge of the base plate 15, these stopping protrusions 17A engaging stepped members 9 of the small female terminal fittings 6A. Four stopping protrusions 17B are formed on the other edge of the base plate 15, these stopping protrusions 17B engaging stepped members 9 of the large female terminal fittings 6B.

A resilient stopping member 19 is formed on approximately the central portion, in a length-wise direction, of a protruding edge of the guiding plate 16. This resilient stopping member 19 is capable of bending and has a cantilevered shape facing an anterior direction relative to the direction of insertion (left in FIG. 7). A fitting protrusion 20 is formed on an outer face of a tip thereof. Furthermore, an operating member 21 protrudes from a base end of the resilient stopping member 19, and a cut-away portion at a posterior side thereof, relative to the direction of insertion, forms a detecting groove 22.

A retainer insertion groove 23, to allow the insertion of the retainer 14, is formed on a short side face on one end of the housing main body 2. Specifically, this retainer insertion groove 23 is formed between the upper and lower rows of cavities 5A and 5B and faces a direction intersecting with the direction of insertion of the female terminal fittings 6A and 6B. The retainer insertion groove 23 also has a cross-sectional T-shape, and a base plate insertion chamber 24, into which the base plate 15 of the retainer 14 is inserted, is provided at the location of the stopping rib 34 at the anterior of the sealing ring 10. Upper and lower edges of the base plate insertion chamber 24 are in the vicinity of the upper and lower cavities 5A and 5B.

Figure 2:
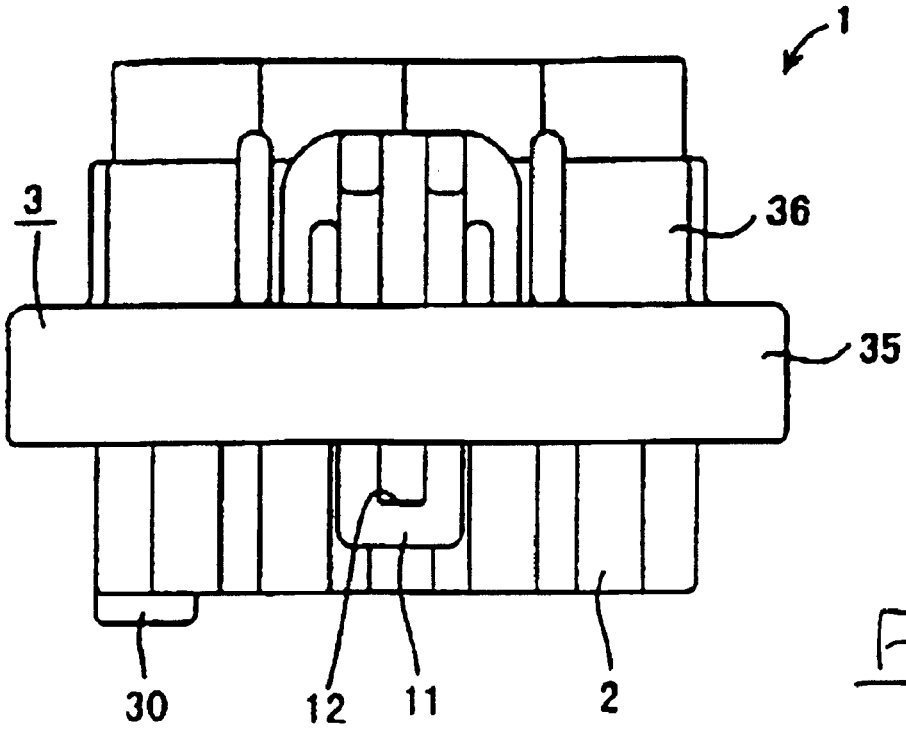
FIG. 2 is a plan view corresponding to FIG. 1.
Figure 7:
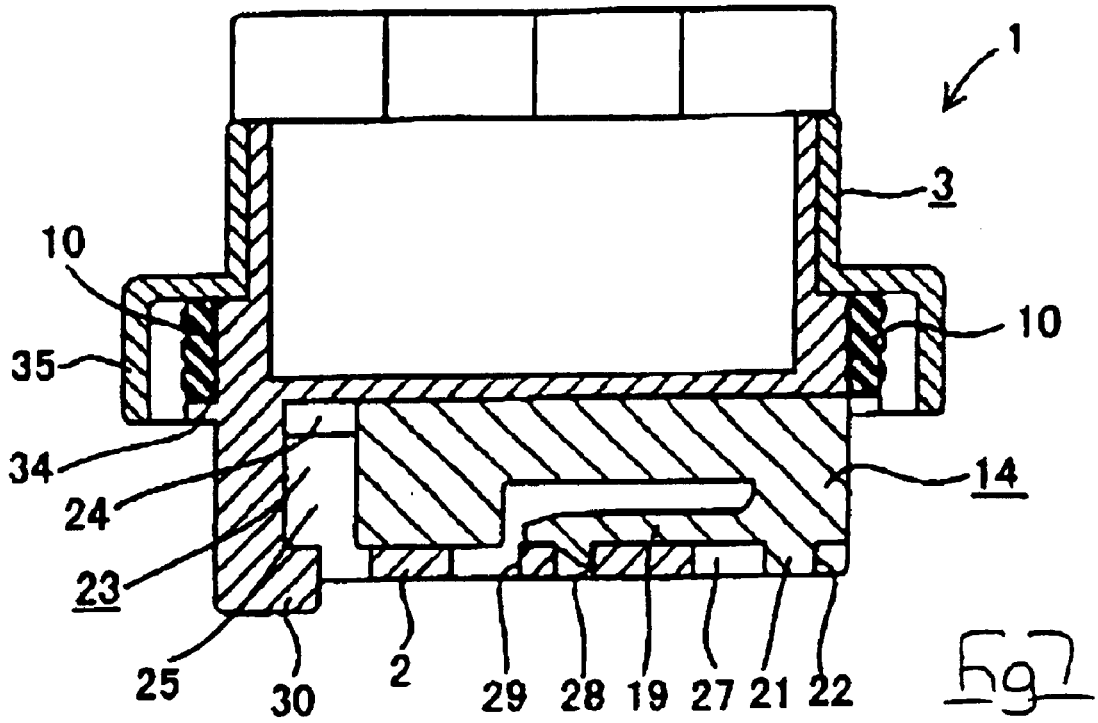
FIG. 7 is a plan cross-section of the retainer in a temporary stopping position.

The guiding plate 16 of the retainer 14 is inserted into a guiding plate insertion chamber 25. As shown in FIGS. 1 and 7, along an anterior face of the guiding plate insertion chamber 25 there are formed (in the direction of the retainer 14): a sliding hole 27 in which the operating member 21 can slide, a temporary stopping hole 28 and a main stopping hole 29 into which the fitting protrusion 20 of the resilient stopping member 19 can be fitted in turn. Further, as shown in FIGS. 2 and 3, a detecting protrusion 30 protrudes from an anterior face of the housing main body 2 at a location to the anterior of the main stopping hole 29 and in a straight line therewith. The length of the protrusion of this detecting protrusion 30 is approximately identical with the cut-away depth of the detecting groove 22 of the retainer 14.

Figure 9:
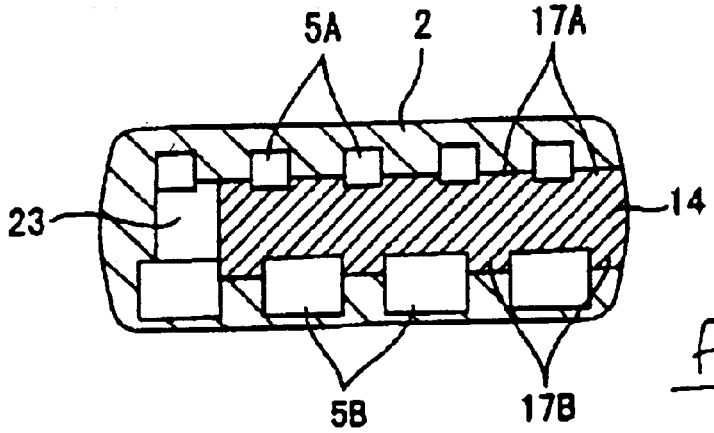
FIG. 9 is a schematic cross-section of the retainer in the temporary stopping position.

As shown in FIG. 7, when the retainer 14 is inserted into the retained insertion groove 23 of the housing main body 2, the fitting protrusion 20 of the resilient stopping member 19 fits into the temporary stopping hole 28 (located closest relative to the direction of insertion) and is maintained therein in a temporary stopping position. In this temporary stopping position, as shown in FIG. 9, the stopping protrusions 17A and 17B of the base plate 15 of the retainer 14 are in a state whereby they are moved away from the cavities 5A and 5B. Moreover, as shown in FIGS. 7 and 9, a posterior end (relative to the direction of the insertion) of the retainer 14 enters into the retainer insertion groove 23 and forms a unified face with a side face of the housing main body 2.

Figure 8:
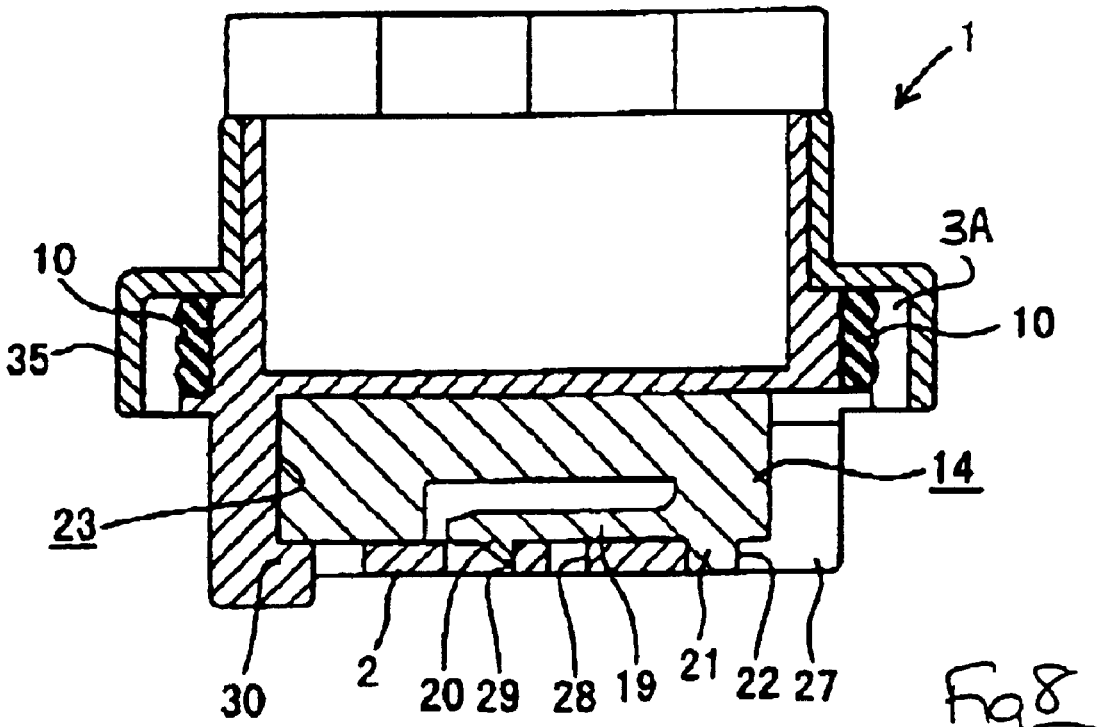
FIG. 8 is a plan cross-section of the retainer in a main stopping position.
Figure 10:
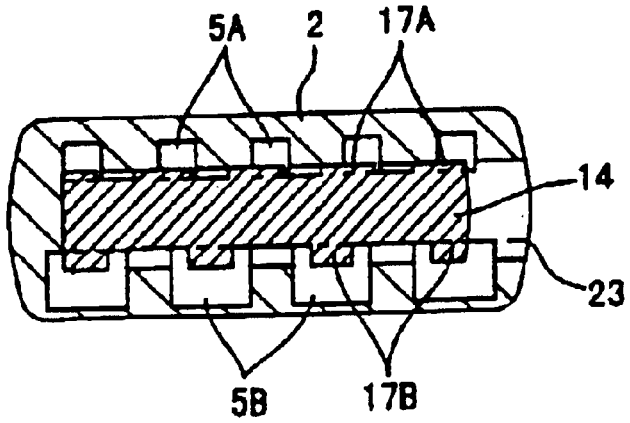
FIG. 10 is a schematic cross-section of the retainer in the main stopping position.

When the retainer 14 is pushed in further from the temporary stopping position, as shown in FIG. 8, the fitting protrusion 20 of the resilient stopping member 19 fits into the main stopping hole 29 and is maintained therein in a main stopping position. In this main stopping position, as shown in FIG. 10, the stopping protrusions 17A and 17B of the base plate 15 of the retainer 14 protrude into the cavities 5A and 5B. The retainer 14 is in a state whereby it is entirely within the housing main body 2.

Next, the corresponding male connector M will be explained with the aid of FIGS. 12 to 15. The male connector M is a panel-mounted connector made from plastic and provided with the male housing 41. The cylindrical fitting member 42 is formed on an anterior face of the male housing 41, this cylindrical fitting member 42 fitting tightly with an inner side of the hood member 35 of the hood 3 attached to the female housing 1. A terminal housing member 44, formed separately from plastic, is installed in an innermost end within the cylindrical fitting member 42.

Five small cavities 45A are formed in an aligned manner at an upper level within the terminal housing member 44, and four large cavities 45B are formed in an aligned manner at a lower level within this terminal housing member 44. When the terminal housing member 44 is pushed to the innermost end within the cylindrical fitting member 42, stopping claws 46 provided on upper and lower faces of the terminal housing member 44 are engaged by, respectively, a stopping protruding member 47 and a stopping groove member 48 formed on upper and lower inner walls of the cylindrical fitting member 42, and are maintained in an unremovable state. Furthermore, terminal through holes 50 are formed on portions which protrude from a posterior end of the cylindrical fitting member 42, these terminal through holes 50 passing through to the upper and lower cavities 45A and 45B.

Small male fittings 66A and large male terminal fittings 66B (shown by the chain line in FIG. 1) are inserted into the small cavities 45A and the large cavities 45B respectively, these terminal fittings 66A and 66B being inserted from the posterior via the terminal through holes 50 and being located opposite to each other. A metal lance 67 provided on each of these terminal fittings 66A and 66B fits into a stopping groove 52 provided on a side wall of each cavity 45AS and 45B, the male terminal fittings 66A and 66B being thereby engaged and housed in an unremovable state in which tabs 78 protrude into the cylindrical fitting member 42.

Figure 13:
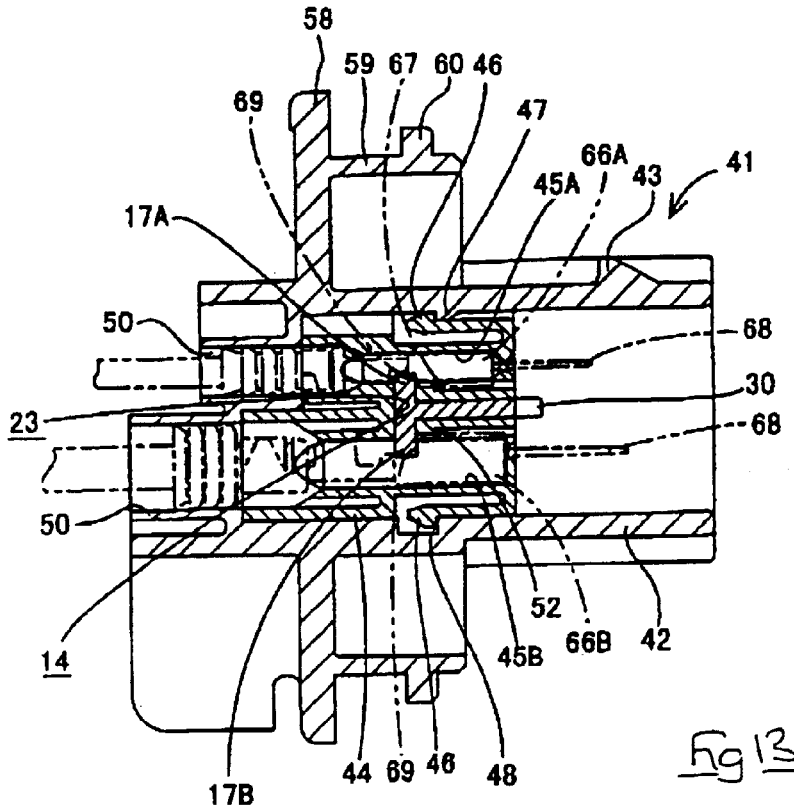
FIG. 13 is a vertical cross-section through the male connector.

Furthermore, the male terminal fittings 66A and 66B are omitted in figures other than FIG. 13.

Figure 14:
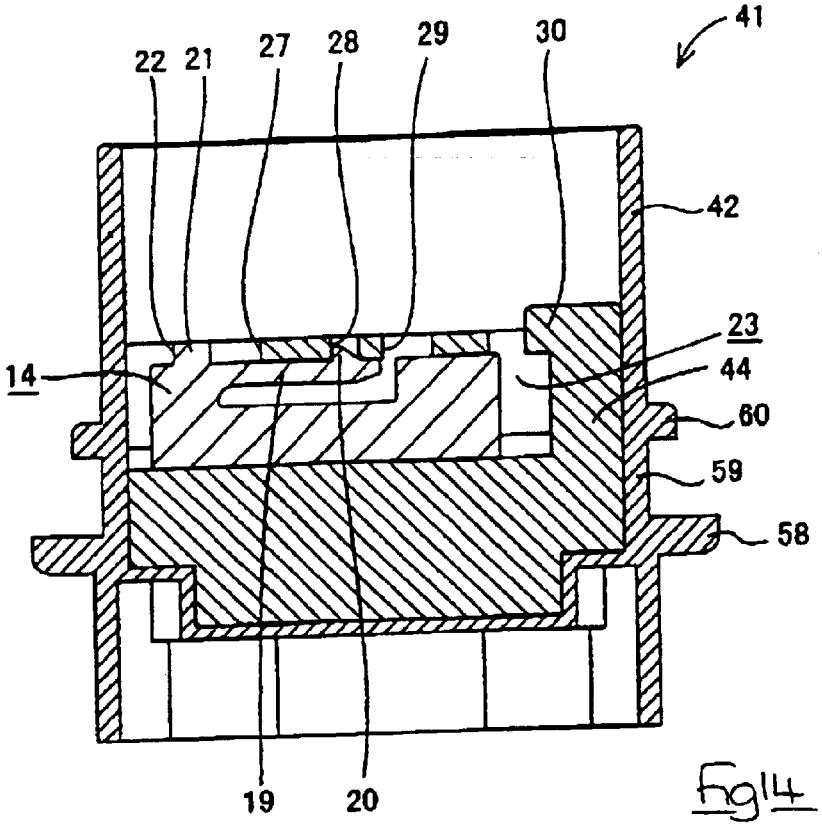
FIG. 14 is a plan cross-section of the retainer in the temporary stopping position.

A retainer 14 is installed on the terminal housing member 44 in order to doubly stop the male terminal fittings 66A and 66B. This retainer 14 is identical with the retainer 14 installed on the female connector F, and a retainer insertion groove 23 is formed in a short side face of one end of the terminal housing member 44 and faces a direction corresponding laterally to the retainer insertion groove 23 of the female connector F. This retainer 14 and retainer insertion groove 23 are identical in form with those of the female connector F, and accordingly their components have been given the same numbers and an explanation thereof is omitted. Moreover, as shown in FIG. 14, a detecting protrusion 30 protrudes from an anterior face of the terminal housing member 44 at a location to the anterior of a main stopping hole 29.

Before the terminal housing member 44 is installed within the cylindrical fitting member 42 of the male housing 41, the retainer 14 is inserted into the retainer insertion groove 23 of the terminal housing member 44 while this terminal housing member 44 is still at the exterior, and a fitting protrusion 20 of a resilient stopping member 19 first fits into a temporary stopping hole 28 and is maintained therein in a temporary stopping position. In this temporary stopping position, stopping protrusions 17A and 17B of a base plate 15 of the retainer 14 are in a state whereby they are moved away from the cavities 45A and 45B. The terminal housing member 44 is installed within the cylindrical fitting member 42 while the retainer 14 is in the temporary stopping position and then, after the male terminal fittings 66A and 66B have been housed within the cavities 45A and 45B, the retainer 14 is pushed in towards a main stopping position. In this main stopping position, the fitting protrusion 20 of the resilient stopping member 19 fits into a main stopping hole 29, and is maintained therein in the main stopping position, and the stopping protrusions 17A and 17B of the base plate 15 of the retainer 14 protrude into the cavities 45A and 45B and engages stepped members 69 of the male terminal fittings 66A and 66B.

Furthermore, when the retainer 14 of the male connector M is in the main stopping position, a detecting groove 22 of the retainer 14 is moved to a position which allows the insertion of the detecting protrusion 30 protruding from the anterior face of the housing main body 2 of the female connector F.

Moreover, when the retainer 14 of the female connector F is in the main stopping position, the detecting groove 22 of that retainer 14 is moved to a position which allows the insertion of the detecting protrusion 30 protruding from the anterior face of the terminal housing member 44 of the male connector M.

Figure 12:
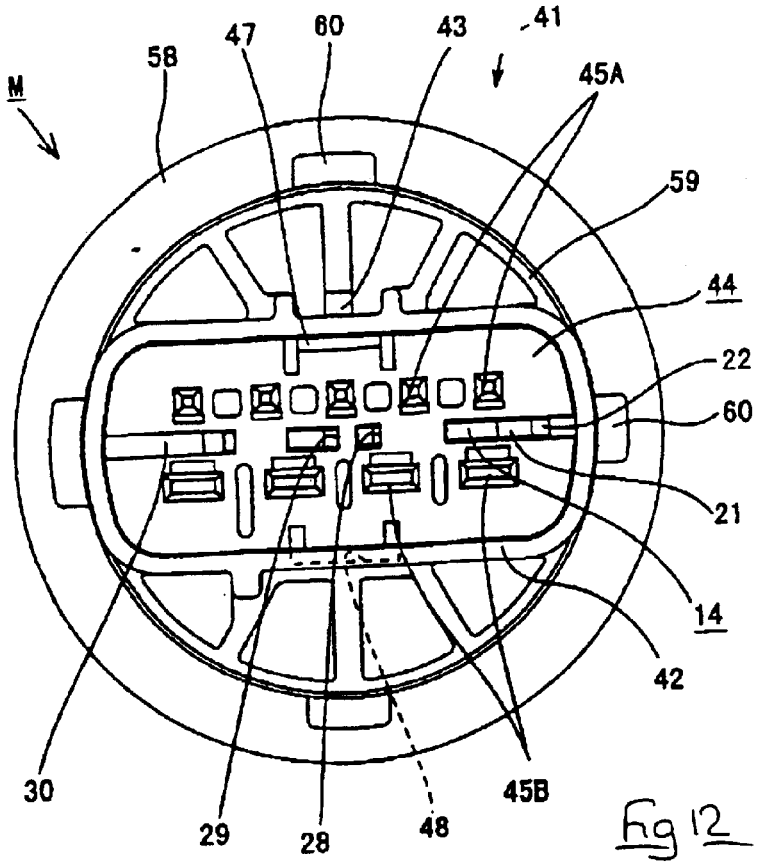
FIG. 12 is a front view of a male connector.

The male connector M is capable of being attached to an attachment hole 56 of a panel 55 (see FIG. 16) and, as shown in FIGS. 12 and 13, a flange 58 is provided at an outer circumference of a posterior end of the cylinder fitting member 42 of a circular wall 59 protrudes from an anterior face of this flange 58 and fits with the interior of the attachment hole 56. Protruding members 60, mutually separated by 90° angles, protrude from an outer circumference of the circular wall 59, these protruding members 60 being inserted into recessed grooves formed by cutting into a hole edge of the attachment hole 56.

Next, the operation of the present embodiment, configured as described above, will be explained.

The male connector M is assembled as follows. First, the retainer 14 is inserted into the retainer attachment groove 23 of the terminal housing member 44 and is maintained in the temporary stopping position. In this state, the terminal housing member 44 is pushed into the cylindrical fitting member 42 of the male housing 41 and, as shown in FIG. 13, the stopping claw 46 provided on the upper and lower faces of the terminal housing member 44 are resiliently engaged by the stopping protruding member 47 or the stopping groove member 48, and are maintained in an unremovable state (see FIG. 14). Next, the small male terminal fittings 66A and the large male terminal fittings 66B are inserted into the upper and lower cavities 45A and 45B via the terminal through holes 50 located at the posterior end, and the male terminal fittings 66A and 66B are retained by the metal lances 67 and are housed in the terminal housing member 44.

Figure 15:
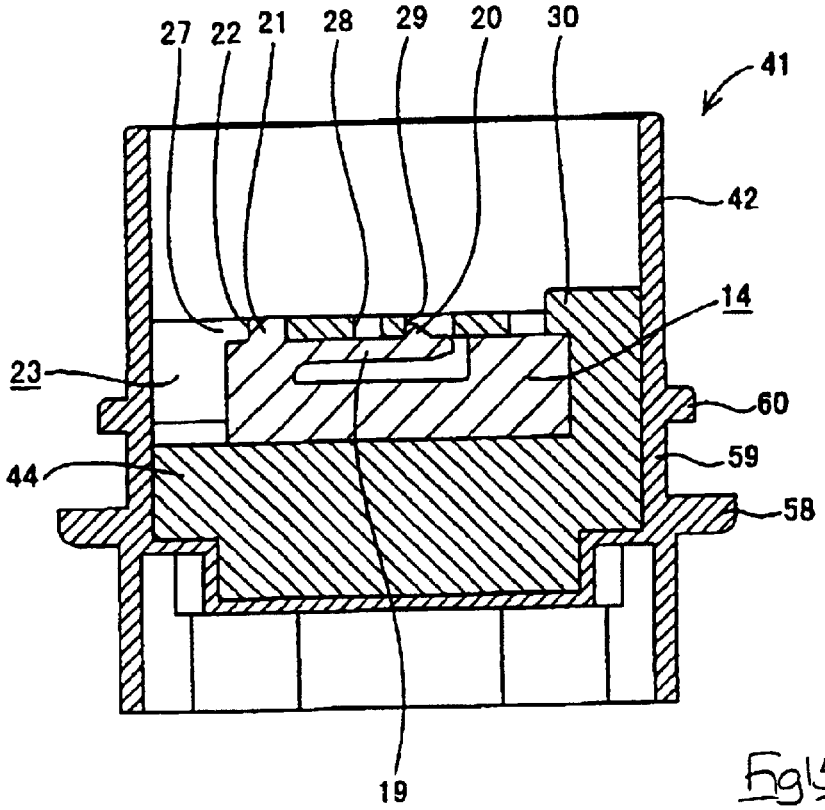
FIG. 15 is a plan cross-section of the retainer in the main stopping position.

Next, a jig is inserted into the cylindrical fitting member 42 from the anterior face side to engage the operating member 21 and, as shown in FIG. 15, to move the retainer 14 to the main stopping position. As a result, the stopping protrusions 17A and 17B of the retainer 14 protrude into the cavities 45A and 45B and engage posterior faces of the stepped members 69 of the male terminal fittings 66A and 66B, thereby doubly stopping the male terminal fittings 66A and 66B in an unremovable state.

Figure 16:
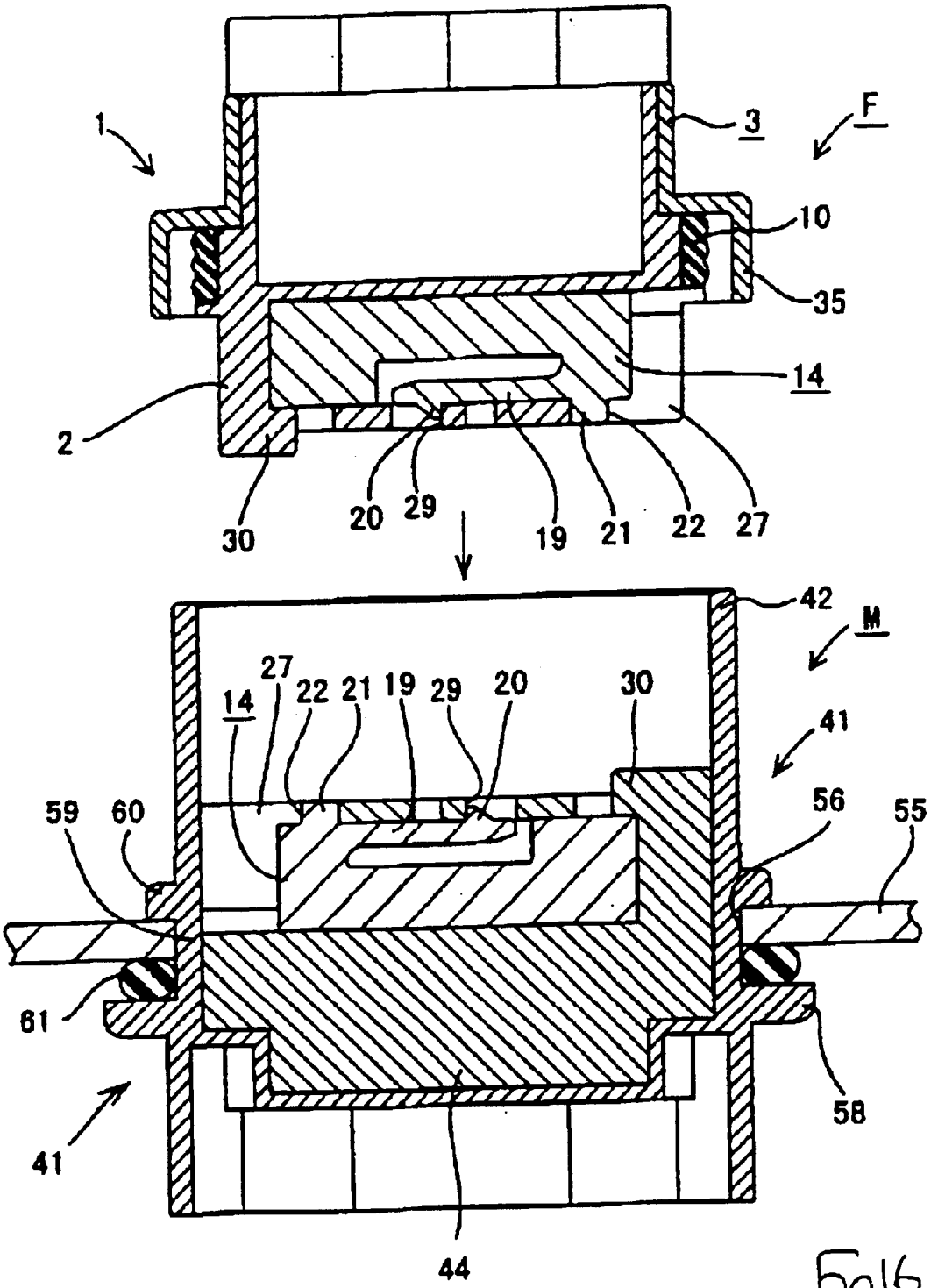
FIG. 16 is a plan cross-section showing the two connectors being fitted together.
Figure 17:
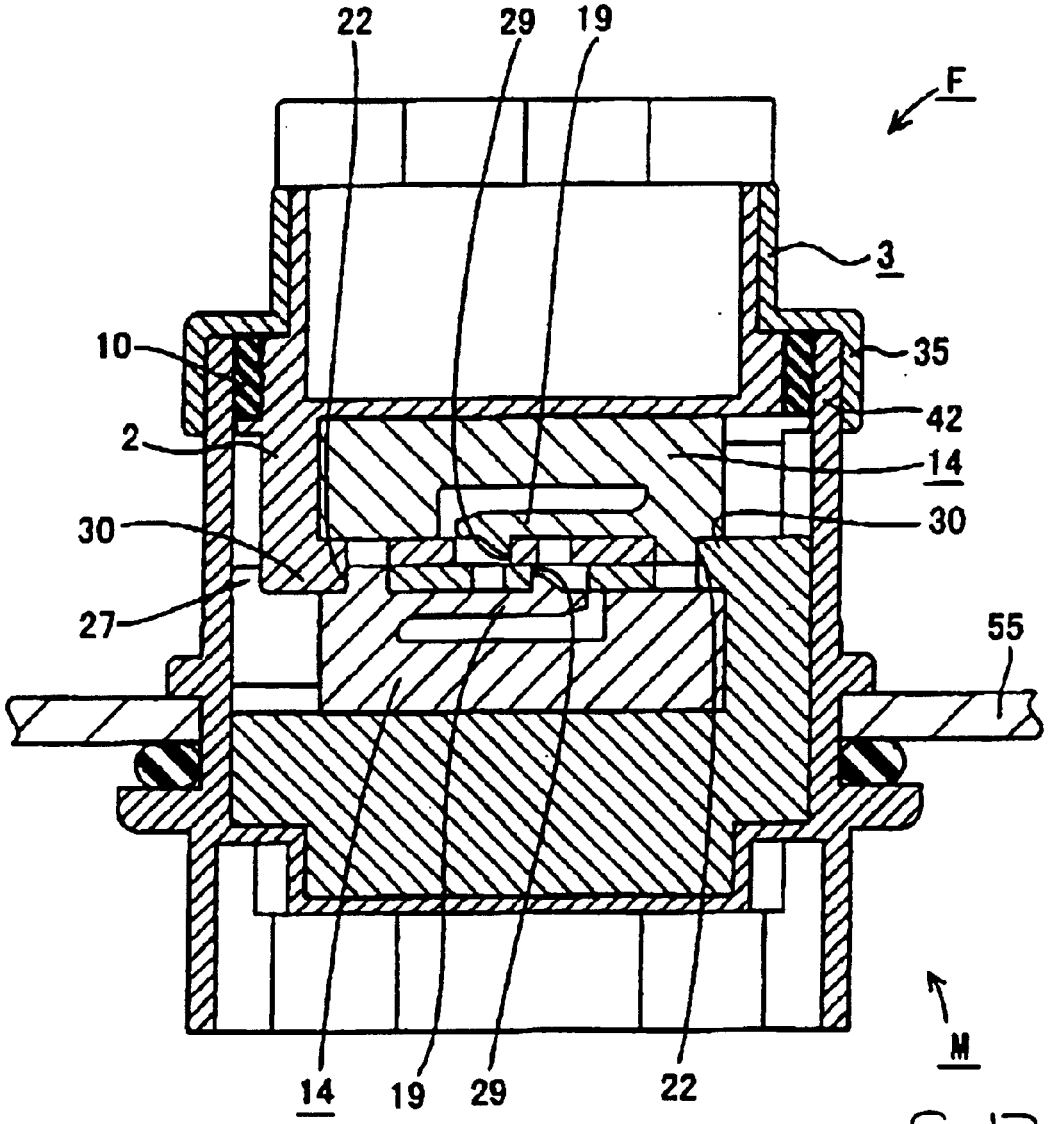
FIG. 17 is a plan cross-section showing the two connectors in a correctly fitted state.

After the assembly of the male connector M has been completed, the protruding members 60 are fitted into the recessed grooves provided on the hole edge of the attachment hole 56 of the panel 55, the circular wall 59 is pushed into the attachment hole 56, and the flange 58, separated by packing 61, is rotated on its axis at a protruding point of the panel 55. As shown in FIG. 16, the flange 58 of the protruding members 60 tightly grip inner and outer opening edges of the attachment hole 56, and the male connector M is thereby fixed to the panel 55.

The female connector F is assembled as follows. First, the retainer 14 is inserted into the retainer insertion groove 23 of the housing main body 2 and is maintained in the temporary stopping position shown in FIG. 7. In this temporary stopping position, as shown in FIG. 9, the stopping protrusions 17A and 17B of the base plate 15 of the retainer 14 are in a state whereby they are moved away from the cavities 5A and 5B, and are consequently in a state whereby the female terminal fittings 6A and 6B can be inserted. Then the retainer 14 enters the retainer insertion groove 23.

Next, the sealing ring 10 is fitted at the posterior face of the stopping rib 34 of the housing main body 2 and then the hood 3 is fitted from the posterior of the housing main body 2. As stated earlier, when the stepped members 37 at the innermost sides of the hood member 35 make contact with the posterior end of the sealing ring 10, the protrusions 38 of the housing main body 2 fit with the attachment holes 39 of the attachment cylinder 36, and the hood 3 is thereby attached in a unified manner. The hood member 35 covers the area from the sealing rings 10 to the stopping rib 34, and the sealing rings 10 are gripped and maintained between the stopping rib 34 and the stepped members 37.

The female housing 1, with the retainer maintained in the temporary stopping position, is transported to the location where the terminals are to be inserted. Then the small female terminal fittings 6A and the large female terminal fittings 6B are inserted respectively into the upper small cavities 5A and the lower large cavities 5B formed in the housing main body 2. They are retained by the metal lances 7 and are housed therein.

Figure 11:
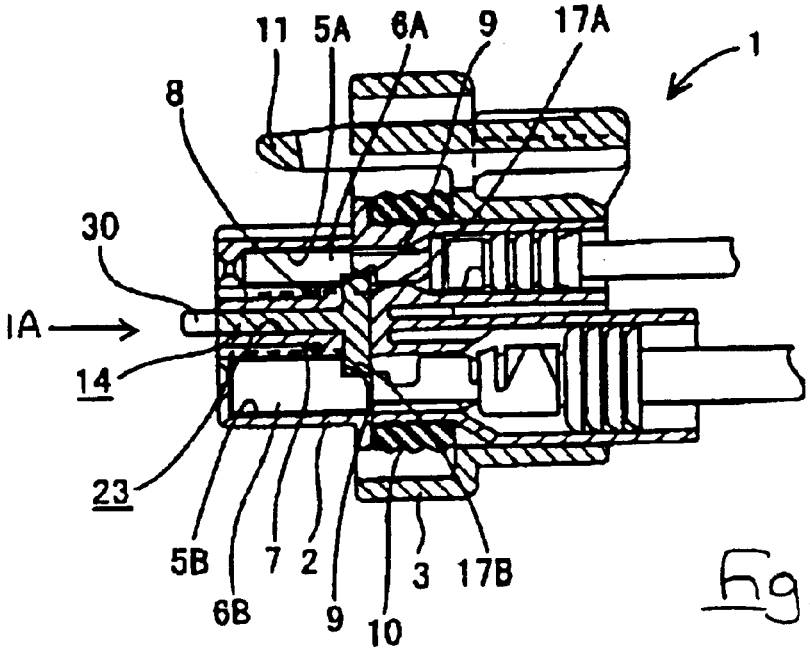
FIG. 11 is a vertical cross-section of the retainer in the main stopping position.

After the insertion of the female terminal fittings 6A and 6B has been completed, a jig is inserted from the anterior face to engage the operating member 21 of the retainer 14, and the retainer 14 is moved to the main stopping position as shown in FIG. 8. When this has been done, as shown in FIG. 10, the stopping protrusions 17A and 17B of the base plate 15 of the retainer 14 protrude into the cavities 5A and 5B and, as shown in FIG. 11, engage posterior faces of the stepped members 9 of the female terminal fittings 6A and 6B, thereby doubly stopping the female terminal fittings 6A and 6B in an unremovable state.

After the female connector F has been assembled in the manner described above, the female connector F is fitted with the male connector M attached to the panel 55, as shown by the arrow in FIG. 16. As the female connector is fitted, the locking arm 11 bends and the cylindrical fitting member 42 of the male housing 41 is inserted into the hood 3 of the female housing 1 and, as the fitting is almost completed, the detecting protrusions 30 of the male connector M and the female connector F enter mutually into the corresponding sliding holes 27 via the detecting grooves 22 of the retainers 14. When the two connectors F and M are correctly fitted together, the protrusion 43 on the male housing 41 fits into the stopping hole 12 of the locking arm 11, thereby latching the two connectors F and M in a fitted state (see FIG. 17). Moreover, the sealing ring 10 is gripped resiliently between the cylindrical fitting member 42 and the housing main body 2, thereby creating a seal between the two connectors F and M.

Figure 18:
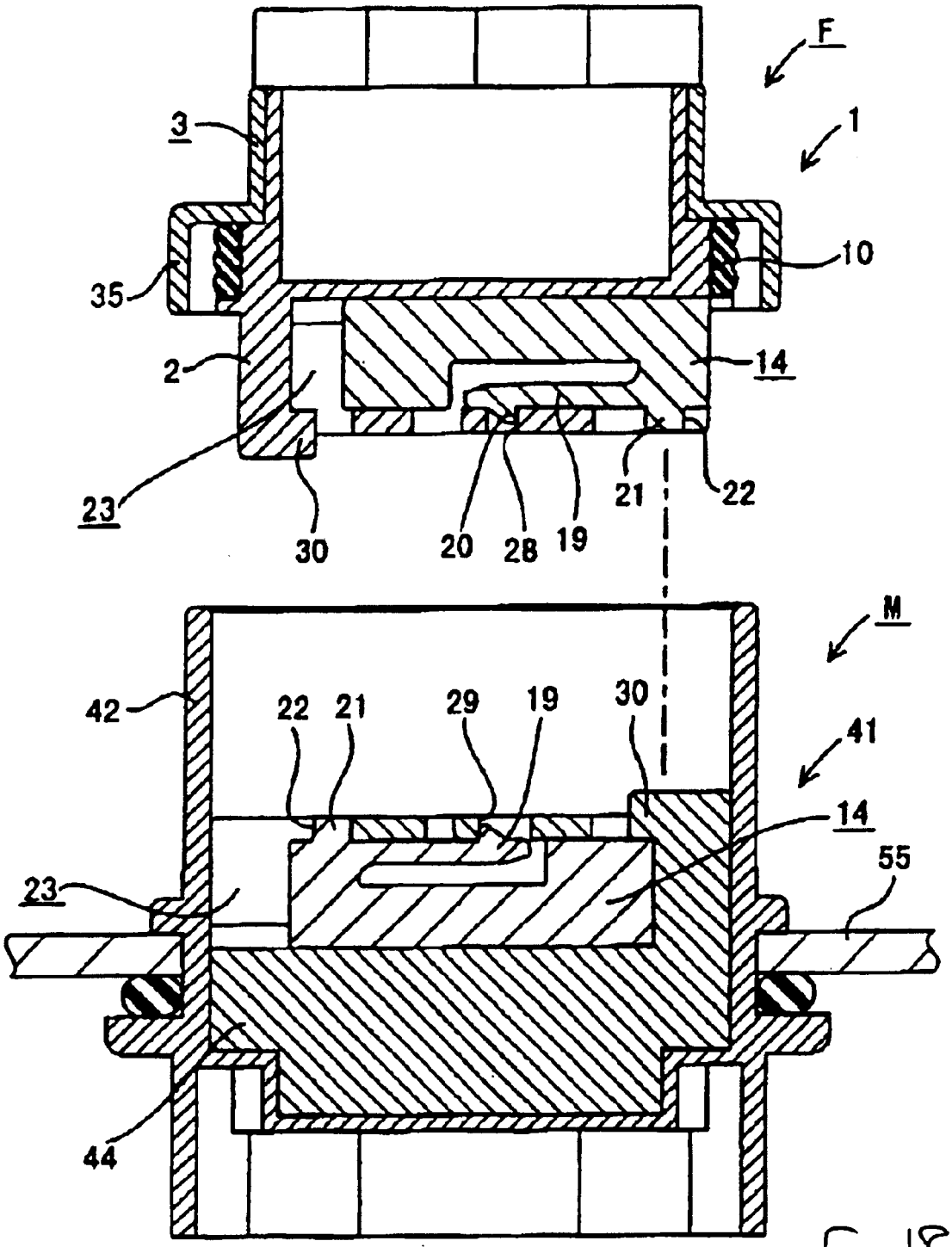
FIG. 18 is a plan cross-section showing the retainer of the female connector remaining in the temporary stopping position while the fitting is taking place.

As shown in FIG. 18, if one forgets to move the retainer 14 of the female connector F to the main stopping position and the two connectors F and M are fitted together while the retainer 14 is still in the temporary stopping position, the position of the detecting groove 22 of the retainer 14 does not correspond with the corresponding detecting protrusion 30 at the anterior face of the terminal housing member 44 and, as a result, the detecting protrusion 30 strikes against the operating member 21 and cannot be fitted as far as the correct position. This can be confirmed by the inability to lock the locking arm 11. If this occurs the two connectors F and M can be fitted together after the retainer 14 is moved to the main stopping position. Further, in the case whereby the retainer 14 of the male connector M is left in the temporary stopping position, the position of the detecting groove 22 of the retainer 14 will, in like fashion, fail to correspond with the corresponding detecting protrusion 30 at the anterior face of the housing body 2, the detecting protrusion 30 willl strike against the operating member 21. As a result the two connectors F and M cannot be fitted together in the correct position and, as above, the fact that the retainer 14 is still in the temporary stopping position can be detected.

If the terminal fittings need to be separated from the corresponding housings for maintenance, etc. this is performed in the following manner.

In the case of the female connector F, the lock of the locking arm 11 is released and the female connector F is pulled away from the male connector M. Then the resilient stopping member 19 of the retainer 14 bends and is released from the main stopping hole 29 while the operating member 21 is engaged by a jig, and the retainer 14 is moved to the temporary stopping position. The engagement of the female terminal fittings 6A and 6B by the retainer 14 is thereby released and, consequently, the engagement of the metal lances 7 is released and the female terminal fittings 6A and 6B can be pulled out towards the posterior.

In the case of the male connector M, the male connector M is separated from the panel 55 and then, as above, from the anterior face the resilient stopping member 19 of the retainer 14 is released from the main stopping hole 29, the operating member 21 is engaged by a jig, and the retainer 14 is moved to the temporary stopping position. The engagement of the male terminal fittings 66A and 66B by the retainer 14 is thereby released and, consequently, the engagement of the metal lances 67 is released and the male terminal fittings 66A and 66B can be pulled out towards the posterior.

The embodiment described above has the following advantages.

In the case of the female connector F, when the retainer 14 is attached to the housing main body 2 in the temporary stopping position, the retainer 14 does not protrude from the side face of the housing main body 2. Consequently, there is no danger that the retainer 14 will be pushed inadvertently into the main stopping position when the hood 3 is attached to the housing main body 2 or while, after this attachment, the female connector F is being transported to the site where the female terminal fittings 6A and 6B are to be inserted.

Moreover, since there is no danger of the retainer 14 being pushed in inadvertently, there is no need for the hood member to perform the function of protecting the retainer 14. Consequently, the hood member 35 needs only to have the size to cover the sealing rings 10 and perform its water-proofing function, thereby allowing a decrease in the cost of materials.

The operating member 21 of the retainer 14 is provided at a location close to the sliding hole 27 which opens onto the anterior face of the housing main body 2. As a result, even when the retainer 14 has been inserted into the housing main body 2, the position of the operating member 12 is visible, and it can be ascertained reliably whether the retainer 14 is in the temporary stopping position or the main stopping position.

Furthermore, the retainer 14 can be engaged with a jig from this anterior face, and the retainer 14 can thereby be moved.

The retainer 14 is provided with the detecting groove 22, and the anterior face of the terminal housing member 44 of the corresponding male connector M is provided with the detecting protrusion 30 and, when the retainer 14 is in the main stopping position, the detecting groove 22 and the detecting protrusion 30 first fit together. As a result, it can be simply and reliably detected whether the two connectors F and M have been correctly fitted together and whether the retainer 14 has been moved correctly to the main stopping position.

Moreover, preventing the retainer 14 from being pushed inadvertently into the main stopping position, the ability to verify the position of the retainer 14 and to move it from the anterior face, and detecting the position of the retainer 14, are all advantages which apply to the male connector M as well.

The present invention is not limited to the embodiments described above with the aid of figures. For example, the embodiments described below also lie within the technical range of the present invention. In addition, the present invention may be embodies in various other ways without deviating from the scope thereof.

(1) When the position of the retainer is to be detected, a detecting protrusion may be provided on a retainer and an opposing face of a corresponding connector may be provided with a detecting groove, this detecting groove allowing the insertion of the detecting protrusion when the retainer is in a main stopping position.

(2) According to the above embodiment, the housing main body and the hood of the female connector are formed separately. However, if a sealing ring is attached from the anterior face side of the housing main body and maintained at a specified position, the housing main body and the hood can be formed in a unified manner.

(3) In the case of the female connector, the retainer insertion groove may be provided so as to pass through two side faces of the housing main body. In this case, when the retainer is pushed in farther to the main stopping position, it is necessary to ensure that the tip of the retainer (relative to the direction of insertion) does not protrude from the side faces of the housing main body.

What is claimed is:

1. An electrical connector comprising:

a housing comprising a wall including a locking member thereon and having a plurality of parallel terminal insertion cavities formed therein, each of said terminal insertion cavities being adapted to receive a respective electrical terminal therein, said housing including:

an end adapted to engage a mating connector, a retainer cavity comprising first and second ends located within said housing, said retainer cavity extending transversely with respect to said plurality of terminal insertion cavities and intersecting said plurality of terminal insertion cavities, and a retainer movably disposed in said retainer cavity for movement transverse to said plurality of terminal insertion cavities between a first retaining position that permits each electrical terminal to move within the respective ones of said terminal insertion cavities in which the electrical terminals have been received, and a second retaining position in which said retainer substantially prevents each electrical terminal from moving within the respective ones of said terminal insertion cavities in which the electrical terminals have been received, wherein said retainer is wholly located within said housing when in the first and second retaining positions, and said retainer includes a protruding portion accessible from an exterior of said housing by which said retainer is movable between said first and second retaining positions, wherein said end includes a face having openings, and said protruding portion is accessible through said openings, wherein a position of said retainer is visually determinable through said openings during movement between said first and second positions.

2. A connector according to claim 1, further including a hood surrounding said housing at a distance and defining an annular chamber, said chamber having an annular seal therein for sealing engagement with a tubular projection of a mating connector.

3. A connector according to claim 2 wherein said hood is attached to the exterior of said housing.

4. A connector according to claim 2, wherein said retainer is between said seal and said end.

5. A connector according to claim 3, wherein said retainer is between said seal and said end.

6. A connector assembly according to claim 1 wherein said retainer includes a resilient member, and said protruding portion forms a portion of said resilient member.

7. An electrical connector comprising:

a housing comprising a wall including a locking member thereon and having a plurality of parallel terminal insertion cavities formed therein, each of said terminal insertion cavities being adapted to receive a respective electrical terminal therein, said housing including:

an end having a face including openings, said end being adapted to engage a mating connector, a retainer cavity located within said housing, said retainer cavity extending transversely with respect to said plurality of terminal insertion cavities and intersecting said plurality of terminal insertion cavities, and a retainer movably disposed in said retainer cavity for movement transverse to said plurality of terminal insertion cavities between a first retaining position that permits each respective electrical terminal to move within the respective ones of said terminal insertion cavities in which the electrical terminals have been received, and a second retaining position in which said retainer substantially prevents each respective electrical terminal from moving within the respective ones of said terminal insertion cavities in which the electrical terminals have been received, said retainer being wholly received in said retainer cavity in both the first and second retaining positions, and including a protruding portion accessible from an exterior of said housing through said openings in said face by which said retainer is movable between said first and second retaining positions.

8. A connector assembly according to claim 7 wherein said retainer includes a resilient member, and said protruding portion forms a portion of said resilient member.

* * * * *